United States Patent [19]

Norton et al.

[11] Patent Number: 4,822,503

[45] Date of Patent: Apr. 18, 1989

[54] METHOD OF MANUFACTURING AN IMPROVED MULTI-GRADE LUBRICATING GREASE

[75] Inventors: James H. Norton, Corunna; William Nywening, Wyoming; Phillip W. Brewster, Camlachie; A. Gordon Alexander, Sarnia, all of Canada

[73] Assignee: Exxon Research and Engineering Company, Florham Park, N.J.

[21] Appl. No.: 37,440

[22] Filed: Apr. 13, 1987

Related U.S. Application Data

[63] Continuation-in-part of Ser. No. 850,516, Apr. 11, 1986, abandoned.

[51] Int. Cl.[4] ..... C10M 129/26; C10M 129/92

[52] U.S. Cl. ..... 252/33.6; 252/49.7; 252/51.5 A

[58] Field of Search ..... 252/49.7, 33.6, 51.5 A

[56] References Cited

U.S. PATENT DOCUMENTS

| | | | |
|---|---|---|---|
| 2,628,942 | 2/1953 | Morris et al. | 252/49.7 |
| 3,224,968 | 12/1965 | Hinkamp | 252/33.6 |
| 3,224,975 | 12/1965 | Hinkamp | 252/51.5 A |
| 3,249,540 | 5/1966 | Gee et al. | 252/33.6 |
| 3,758,407 | 9/1973 | Harting | 252/42.1 |
| 3,791,973 | 2/1974 | Gilani | 252/41 |
| 3,929,651 | 12/1975 | Murray et al. | 252/41 |
| 4,127,493 | 11/1978 | Elliott | 252/51.5 A |
| 4,253,979 | 3/1981 | Alexander | 252/51.5 A |
| 4,388,198 | 6/1983 | Butcask | 252/33.6 |

*Primary Examiner*—William R. Dixon, Jr.
*Assistant Examiner*—Margaret B. Medley
*Attorney, Agent, or Firm*—John W. Ditsler

[57] ABSTRACT

A method for manufacturing a lubricating grease having improved properties is described. The method comprises reacting a pyrrolidone with a fatty amine and subsequently adding a metal hydroxide to the reaction when the unreacted fatty amine content ranges between about 33 and about 66 wt. % of the fatty amine originally added. The grease thus formed will be a NLGI #0 grade grease that has the high temperature stay-in-place properties of a NGLI #2 grade grease.

18 Claims, No Drawings

METHOD OF MANUFACTURING AN IMPROVED MULTI-GRADE LUBRICATING GREASE

CROSS-REFERENCE TO RELATED APPLICATIONS

This Application is a continuation-in-part of U.S. Ser. No. 850,516, filed Apr. 11, 1986, now abanonded.

BACKGROUND OF THE INVENTION

1. Field of the Invention

The present invention relates to the manufacture of a multi-grade lubricating grease having particularly desirable high temperature properties. More specifically, this invention is directed to a method of manufacturing an improved multi-grade grease comprising a lubricating base oil, a fatty amine, a bispyrrolidone derivative and a compound of lithium or other metal.

2. Discussion of Related Art

Greases are often used in place of oils for lubrication where the lubricant is required to maintain its position in a mechanism and where opportunities for frequent relubrication may be limited or not economically justified.

Over the years, a variety of thickening agents for greases have been developed including the alkali salts of fatty acids, clays, polyureas, asbestos, carbon black, silica gels, aluminum complexes, polymers, phthalocyanine, indanthrene, etc. Despite the number and variety of such thickeners, alkali metal soaps are used as the thickening agent in over 90 percent of worldwide grease production. The only non-soap thickeners which have achieved commercial importance are the aluminum complexes, clays and polyureas, and then only to a very limited extent.

The soap thickeners most often used are derived from the saponification of fats and oils by lithium and calcium hydroxides, although the sodium and barium soaps have been used in smaller amounts for special applications. The fats and oils are mostly mixtures of $C_{16}$ and $C_{18}$ fatty acid precursors with the preferred soap being lithium 12-hydroxystearate. This preferred lithium soap thickener is present in over 50 percent of all greases and most all premium multi-purpose greases. Lithium soap greases are described and exemplified in many patents, including, for example, U.S. Pats. Nos. 3,758,407; 3,791,973; and 3,929,651.

Greases generally must exhibit good anti-rust and anti-wear properties. In addition, greases should not exhibit oil-soap separation or excessive softening in use. Relatively firm greases (e.g. National Lubricating Grease Institute #2 grade greases) have proven useful in applications requiring good stay-in-place characteristics, while relatively soft greases (e.g., NLGI#0 grade greases) have proven particularly useful where good adhesion of the grease to metal surfaces is desired. For wheel bearing applications, although a general application grease such as NLGI#2 grade is suitable, softer NLGI#0 grade greases are unsuitable as they do not have good stay-in-place properties and, therefore, tend to bleed from the bearings. Heretofore thickeners have not been formulated which give multi-grade characteristics—namely the desirable stay-in-place properties of a firm grease and the metal adhesion properties and fluidity of a soft grease. Such a multi-grade grease would be particularly useful in automotive wheel bearings, where excessive softening could lead to braking failures and good adhesion of the grease to the metal surfaces is desired to provide the required lubrication. However, to date, there are no commercially available greases which have the combination of desirable stay-in-place properties of a firm grease and the metal adhesion properties and fluidity of a soft grease.

Recently, a new type of chemistry for preparing a grease thickener has been disclosed in U.S. Pat. No. 4,253,979 to Alexander et al., the disclosure of which is incorporated herein by reference. More specifically, patentees disclose therein a lubricating grease composition comprising a base oil, conventional additives and a thickener which in turn comprises the reaction product of a pyrrolidone with a fatty amine to form a fatty monoamide. The fatty monoamide subsequently is reacted with an hydroxide, such as lithium hydroxide, to make the thickener salt. However, the pyrrolidone compound is reacted with the fatty amine under conditions conducive to promoting the complete reaction of the reactants (see the reference to "appropriate molar proportions" at column 3, lines 38–40 and the examples). In addition, all of the examples in Alexander et al. show that the NLGI #2 grade greases prepared pass the high temperature (163° C.) wheel bearing tests (the penetration values in each example correspond to NLGI #2 grade greases). However, greases prepared according to the teachings of the U.S. Pat. No. 4,253,979 would not pass the 163° C. wheel bearing test when "oiled back" (i.e., additional base oil is added) to the softer NLGI #0 grade greases. This result is not unexpected as all commercially available greases demonstrate this behavior.

Therefore, it would be desirable to have available a method of producing a NLGI #0 grade grease that has the high temperature stay-in-place properties of a NLGI #2 grade grease such that the #0 grade grease will consistently pass the 163° C. wheel bearing tests (ASTM test D-1243 at 163° C.).

SUMMARY OF THE INVENTION

According to the present invention, it has now been discovered that the procedures described in U.S. Pat. No. 4,253,979 for forming a lubricating grease composition can be modified to form a different grease having different properties than that taught by patentees. More specifically, a NLGI #0 grade grease having the high temperature stay-in-place properties of an NLGI #2 grade grease can now be produced by reacting a bispyrrolidone with a fatty amine, followed by the addition of an hydroxide (preferably lithium hydroxide) before the reaction of the bispyrrolidone with the amine approaches completion; i.e., when the unreacted fatty amine content ranges between about 33 and about 66 wt. %, preferably between about 36 and 66 wt. % and more preferably between about 40 and about 55 wt. % of the fatty amine originally added.

DETAILED DESCRIPTION OF THE INVENTION

The present invention is directed to a method for producing a NLGI #0 grade grease having the high temperature stay-in-place properties of a NLGI #2 grade grease, which method comprises:

A. reacting a pyrrolidone with a fatty amine; and,

B. adding an hydroxide to the reaction when the unreacted fatty amine content ranges between about 33 and about 66 wt. % of the fatty amine originally added.

The fatty amine utilized preferably comprises $C_{12}$–$C_{30}$ straight chain fatty amines. Among the more preferred fatty amines are $C_{16}$–$C_{22}$ straight chain amines, whle $C_{18}$–$C_{22}$ are most preferred.

The preferred pyrrolidone compound used in the lubricating grease composition of the invention is a derivative of 2-pyrolidone-4-carboxylic acid and has the following general formula:

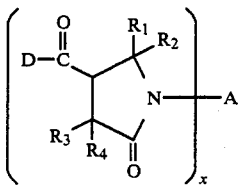

where x is 1 to 3, preferably 1 to 2, and more preferably 2; A is a hydrocarbyl group of 1 to 50 (preferably 1 to 25) carbon atoms; D is the residue or hydroxyl portion of the carboxylic acid group which can be optionally free or neutralized with a suitable metal, organo base or alcohol which provides one or two hydrocarbyl groups of 1 to 50 (preferably 1 to 30) carbon atoms, with the proviso that there is at least one long chain hydrocarbyl group of at least 12 carbon atoms present in either D or A; and $R_1$, $R_2$, $R_3$ and $R_4$ are each hydrogen or a hydrocarbyl group of 1 to 6 (preferably 1 to 4) carbon atoms.

More particularly, in the above formula, A is an alkyl, aryl, alkaryl or aralkyl group of 1 to 50, preferably 1 to 25 and more preferably 1 to 15 carbon atoms when x is 1, A is an alkylene, arylene, alkarylene or aralkylene of 1 to 50, preferably 1 to 25 and more preferably 12 to 22 carbon atoms when x is 2 and A is a trivalent hydrocarbyl radical of 1 to 50, and preferably 1 to 25 carbon atoms when x is 3. It is noted that the unsaturated counterparts of the A groups defined above may be used; however, the saturated groups are preferred. D is represented by an MO—, an

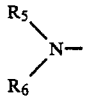

group, or an $R_7O$— group where M is a metal selected from Group I or Group II of the Periodic Table or aluminum and more particularly the alkali metals and the alkaline earth metals, i.e., lithium, sodium, calcium, barium, strontium and magnesium with lithium and sodium being preferred, and more preferably lithium. $R_5$ and $R_6$ may each individually be a hydrocarbyl group and more particularly an alkyl, aryl, alkaryl or aralkyl group and the unsaturated counterparts thereof of 1 to 50, preferably 1 to 30 and more preferably 1 to 25 carbon atoms and one of $R_5$ or $R_6$ may be hydrogen. The groups as defined for $R_5$ and $R_6$ may include heterooxygen or nitrogen atoms interspersed therein. Thus, $R_5$ and $R_6$ groups may contain oxyalkylene groups, particularly oxyethylene and oxypropylene and also may contain nitrogen when a polyamine is used to neutralize the acid group. $R_7$ may be a hydrocarbyl group, and more particularly an alkyl, aryl, alkaryl or aralkyl group and the unsaturated counterparts thereof of 1 to 50, preferably 1 to 30, and more preferably 1 to 25 carbon atoms and additionally $R_7$ may be hydrogen. The saturated forms of $R_5$, $R_6$ and $R_7$ are particularly preferred. $R_1$, $R_2$, $R_3$ and $R_4$ in the above structure will particularly be hydrogen or alkyl of 1 to 6 and preferably 1 to 4 carbon atoms. More preferably, such R groups are hydrogen.

In the above-described pyrrolidone compound, A may include hetero-atoms such as oxygen, sulfur, and nitrogen groups and the term "alkyl" may include cyclic structures. It is further understood that branch-chained structures and other isomers thereof are contemplated by the decribed pyrrolidone structure. The functional D groups may be the same or different when more than one is present. In accordance with the previous description, there may be different combinations of the above A and D groups with the proviso that at least one substantially oil-soluble group; i.e., a long chain hydrocarbon group of at least 12 carbon atoms, is present.

The preferred pyrrolidone structure used in preparing the grease thickeners of the present invention is 1-substituted-2-pyrrolidone-4-carboxylic acid which is obtained by reacting a suitable primary amine with an $\alpha$-alkylidene substituted carboxylic acid or ester which preferably is itaconic acid. This is a well-known reaction which is used to obtain intermediates for the plastic industry as disclosed in U.S. Pat. Nos. 2,993,021 and 3,395,130, the disclosures of which are incorporated herein by reference.

The 1-substituted-2-pyrrolidone-4-carboxylic acid described above is then reacted with suitable amines to form the amide derivative, or with an alcohol to form the ester derivative, or with suitable inorganic compunds (e.g. hydroxides, carbonates and alkoxides) to form the metal salt. As indicated above, when there is more than one carboxyl group on the starting pyrrolidone compound, different functional groups (i.e. D as shown on the above-designed formula) may be added to each. This is accomplished by using the appropriate molar proportions of the respective starting materials needed to provide the desired functional groups. As an example, a bispyrrolidone made from a diamine (preferably an aromatic diamine) is condensed with an amine (preferably a long chain fatty amine) to form an amide derivative with one carboxyl group which is then neutralized with a metal salt.

The amines useful in preparing the pyrrolidone amide derivatives of this invention may be a primary or secondary amine and may be a mono-, di- or polyamine. Examples of such amines include methylamine, ethylamine, diethylamine, ethylene diamine, n-propylamine, isopropylamine amylamine, cyclohexylamine, octylamine, dioctylamine, decylamine, dodecylamine, hexadecylamine, octadecylamine, dioctadecylamine, coco amine, dicoco amine, N-cocotrimethylenediamine, tallow amine, di-cosylamine, enosyl-docosylamine, di(eicosyl-docosyl) amine, N-octadecenyltrimethylene diamine, aniline, toluidine, sylidine, N-methylaniline, benzylamine, diphenylamine, amines derived from rapeseed oil, phenethylamine, mixtures of amines such as Primene 81-R (principally t-$C_{12}H_{25}NH_2$ to t-$C_{14}H_{29}NH_2$) and Primene JM-T (principally t-$C_{18}H_{37}NH_2$) to t-$C_{22}H_{45}NH_2$). Mixtures of these and other amines may also be employed. Further examples of amines which may be used are disclosed in Kirk-Othmer Encyclopedia of Chemical Technology, Second Edition, Vol 2., 1963, pp 138 and 411–426, the disclosures of which are incorporated herein by reference.

Alcohols and other hydroxy compounds useful in preparing the pyrrolidone ester derivative include ethyl alcohol, butyl alcohol, n-decyl alcohol, cetyl alcohol, stearyl alcohol, eicosonyl alcohol, hentriacontanol, phenol, benzyl alcohol and phenylethyl alcohol. Other useful alcohols are disclosed in Kirk-Othmer Encyclopedia of Chemical Technology, Second Edition, Vol 1, 1963, pp. 531–568, the disclosure of which is incorporated herein by reference.

The metal compounds useful in preparing the salt derivative of pyrrolidone include the hydroxides, carbonates and alkoxides of the respective selected metals.

The amines which may be used in preparing the basic or precursor pyrrolidone compound will depend on the desired A group in the final pyrrolidone compound. Such amines include phenylamine (aniline), phenylene diamine, phenylene di(methylamine), naphthylene diamine, 4,4'-bisphenylene diamine, 4,4'-thiobisphenylene diamine, 4,4'-oxybisphenylene diamine, 4,4'-methylenebisphenylene diamine, 4,4'-isopropylidenebisphenylene diamine, octadecylamine, octadecyldiamine, amines of polyisobutylene (up to about 50 carbons) and other amines as described previously.

The total pyrrolidone thickener content of the grease composition of this invention will range from about 1 to about 60 wt. %, preferably from about 2 to about 50 wt. % and more preferably from about 5 to about 30 wt. %, based on the total composition.

The lubricating base oil that is used in preparing the grease compositions of this invention can be any of the conventionally used mineral oils, synthetic hydrocarbon oils or synthetic ester oils. In general, these lubricating oils will have a viscosity in the range of about 35 to 200 SUS at 210° F. Mineral lubricating oil base stocks used in preparing the greases can be any conventionally refined base stocks derived from paraffinic, naphthenic and mixed base crudes. Synthetic lubricating oils that can be used include esters of dibasic acids such as di-2-ethylhexyl sebacate, esters of poly glycols such as trimethylol propane tricaprylate, pentaerythritol tetraoctanoate, dipentaerythritol tricaprylate tripelargonate esters of glycols such as $C_{13}$ oxo acid diester of tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as alkyl benzenes (e.g. alkylate bottoms from the alkylation of benzene with tetrapropylene) or the copolymers of ethylene and propylene, silicone oils (e.g. ethyl phenyl polysiloxanes, methyl polysiloxanes, etc.), polyglycol oils, (e.g., those obtained by condensing butyl alcohol with propylene oxide), and carbonate esters (e.g., the product of reacting $C_8$ oxo alcohol with ethyl carbonate to form a half ester followed by reaction of the latter with tetraethylene glycol, etc.). Other suitable synthetic oils include the polyphenyl ethers; e.g., those having from about 3 to 7 ether linkages and about 4 to 8 phenyl groups (see U.S. Pat. No. 3,424,678, column 3).

The initial lubricating base oil content of the grease relative to the oil content in the finished grease is not critical to the practice of the present invention and will be essentially the same as the initial oil content of conventional greases. Accordingly, the initial oil content will typically range from about 20 to about 55 wt. %, preferably from about 30 to about 40 wt. %, of the oil content present in the finished grease. Preferably the lubricating base oil will comprise the major amount of the finished grease composition.

A particularly preferred monoamide precursor is prepared by the reaction of itaconic acid and 4,4'-methylenedianiline according to reaction 1 below:

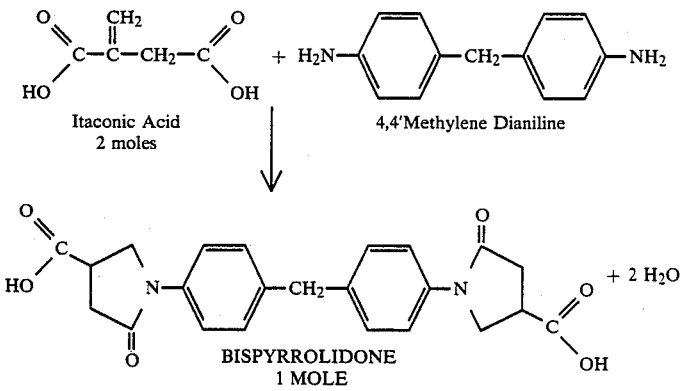

The bispyrolidine is then reacted with a straight chain fatty amine according to reaction 2 below:

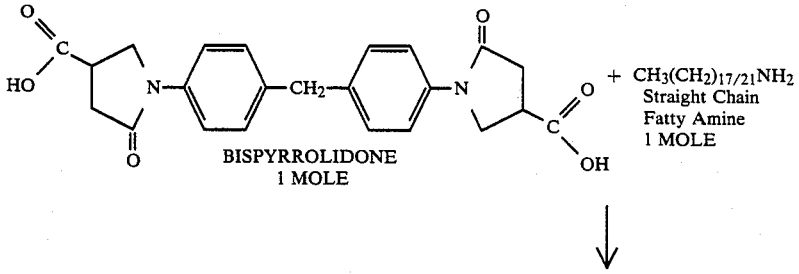

-continued

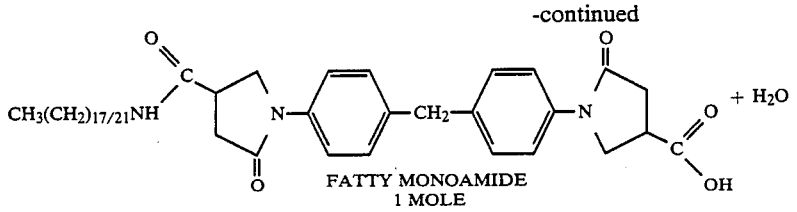

The critical aspect of the present invention is the discovery that NLGI #0 grade greases having the high temperature stay-in-place properties of NLGI #2 grade greases may be prepared if the reaction of the bispyrolidone and the fatty amine (reaction 2) is only partially completed prior to the addition of a basic metal compound (such as lithium hydroxide) which reacts with free carboxy groups according to reaction 3 below

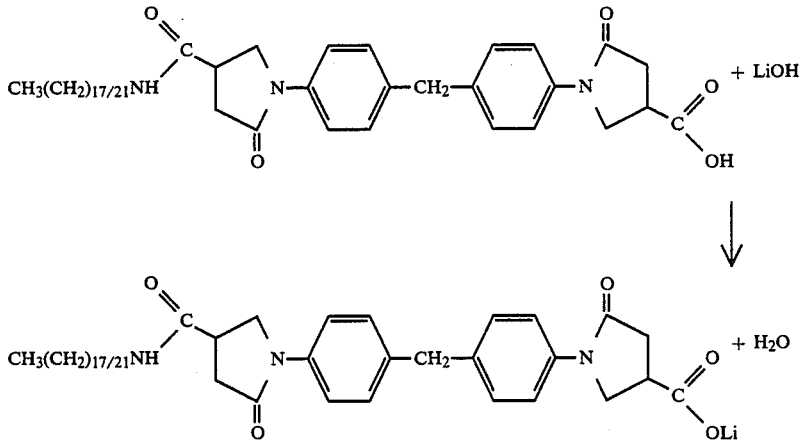

or with other free carboxy groups; e.g. with bispyrrolidone.

The lubricating greases of the present invention can be manufactured either in a batch or a continuous operation. In both methods the extent to which the fatty amine is reacted prior to the addition of the metal hydroxide is critical. Accordingly, the concentration of unreacted fatty amine should be monitored such that the metal hydroxide will be added to the mixture when the unreacted fatty amine content ranges between about 33 and about 66 wt. % of the fatty amine originally added. One method for determining the extent to which the fatty amine has been reacted is by periodically titrating a sample of the reaction mixture after the addition of methyl violet indicator in a solution of perchloric acid and glacial acetic acid to an end point color change from blue to pale green.

The NLGI #0 grade grease thus produced will have the high temperature stay-in-place properties of a NLGI #2 grade grease. By "high temperature stay-in-place properties" is meant a grease which has less than 10, preferably less than 5, grams leakage and essentially no slumpage when the ASTM D-1263 wheel bearing test is performed at a temperature between about 90° C. and about 200° C. Creases formed as described herein will be particularly useful in applications in which good adhesion to metal surfaces and stay-in-place properties are desirable; e.g. wheel bearings. Also, such greases would be particularly well suited for use in machinery operating in colder climates due to improved fluidity and pumpability. A variety of performance additives such as antioxidants, anti-wear, extreme pressure, anti-rust, anti-corrosion, tacifiers, etc. may also be included in the finished grease of the present invention.

The present invention will be further understood by reference to the following Examples which are not intended to restrict the scope of the claims appended hereto.

EXAMPLE 1

In this Example, a lubricating grease of the present invention was prepared as follows. First, a bispyrrolidone salt was formed according to reaction (1) above by blending 195 g. itaconic acid (ITA) with 148.5 g. of 4,4'-methylenedianiline (MDA) in 200 g. of MCT 10 base lube oil, a solvent refined 90 VI 150 Neutral base oil. The blend then was reacted for 30 minutes at 130° C. with constant stirring. The consistency of the reaction mixture changed as the degree of reaction progressed—from a melt, to a syrup, to the formation of plastic-like particles. These particles changed to hard lumpy larger particles and finally into particles having a fine, beach sand-like consistency. The mixture then was transferred to a blender to which an additional 400 g. of MCT 10 base lube oil was added and mixed for five minutes to break-up any lumps and to reduce the material to a fine, hard powder. Two hundred grams of Iosol 1520 solvent, a naphtha-type solvent having a boiling range of about 150°-200° F. manufactured by Imperial Oil Ltd., Canada, was added to facilitate handling after-which the reaction mixture was passed through a Buchner filter. The solid reaction product was washed free of oil with additional Iosol 1520 and then dried. The yield of bispyrrolidone salt was approximately 97-98 weight percent of that which theoretically should have been obtained.

Bispyrrolidone powder (157.5g) was slurried in 600 g. of MCT 30 base lube oil (a solvent refined 90 VI 600 Neutral base oil) and heated to about 130° C. with constant stirring, after which 118.1g. of a fatty amine having the structural formula $CH_3(CH_2)_{17/21}$—$NH_2$ was added and allowed to react for a period of time sufficient for the unreacted fatty amine concentration to decline to the desired level; i.e. between about 33 to about 66 wt. % of the fatty amine originally added. Normally, this will occur in about 1–3 hours. The fatty amine used was a commercial grade amine derived from hydrogenated erucic acid rapeseed oil, which is commercially available as Armeen HR sold by Armak Chemical Ltd. of Chicago, Ill. Then, 15.75 g. of lithium hydroxide hydrate was added to the mixture at 150° C. over a 30 minute period, during which time the temperature dropped to about 100° C. with continuous mixing. Subsequently, the temperature was raised to 150° C. for an additional 30 minutes. The temperature then was raised to about 160° C. over a 10 minute period and 1,048 g. of MCT 30 base lube oil was added (i.e., "oiled-back") as the grease was allowed to cool to about 50° C. Performance additives such as antioxidants, anti-wear, extreme pressure, anti-rust, anti-corrosion, tacifiers, etc. were then blended in and the grease passed through a conventional mill, such as a Charlotte or Morehouse mill. The consistency of the finished grease was adjusted to the proper NLGI grade by "oiling back" and making any necessary adjustments in the additive content.

EXAMPLE 2

Alternatively the greases of the present invention may be prepared by a somewhat different procedure. A bispyrrolidone was prepared by blending 195 g itaconic acid with 148.5 g of 4,4'methylene dianiline in a pulverizing device (such as a blender) to reduce the contents to a homogeneous powder. The powder was placed in thin layers on sheets and introduced into an oven at 140° C. The powder quickly melted to a bubbling reddish liquid which was transformed into a hard yellow solid in approximately 15 minutes. The solid was pulverized again until the product passed through a 420 mesh screen. The resulting bispyrrolidone then was reacted with the fatty amine and lithium hydroxide as set forth above in Example 1.

EXAMPLE 3

The utility of the present invention in producing a multi-grade lubricating grease having the consistency of a NLGI #0 grade grease and the wheel bearing performance of NLGI #2 grade or firmer grade greases (e.g. NLGI #3 grade greases or higher) is described below. Wheel bearing tests were performed on various grease samples following a slightly modified procedure of ASTM test D-1263, the disclosure of which is incorporated herein by reference. In this test, a standard wheel bearing and hub arrangement is mounted in a temperature controlled cabinet and turned at high speed. Standard procedures are used to pack the wheel bearing and hub. The test was run for six hours at 163° C., afterwhich the wheel bearing and hub assembly was taken apart and analyzed for bleed and slump.

Conventional commercial grade lithium complex greases were utilized for comparison purposes in wheel bearing tests. Samples A and B in Table I were NLGI #2 grade, while sample C was NLGI #1 grade. Samples A and B both passed the wheel bearing tests at 163° C. Sample C, an NLGI #1 grade grease, failed the 163° C. wheel bearing test. Samples A, B and C all were non-pyrrolidone-containing greases.

A number of greases having varying levels of unreacted fatty amines present also were tested in the previously described wheel bearing tests at 163° C. The greases were determined to be unacceptable if the grease exhibited indications of slump.

Samples D, E, F and G were pyrrolidone greases prepared as previously described in which the free fatty amine concentrations were 13.8 weight percent, 16.4 weight percent, 27.4 weight percent and 81.0 weight percent, respectively, prior to the addition of lithium hydroxide. Samples D, E and F, NLGI #0 grade greases, all failed the wheel bearing tests at 163° C. Grease F also failed the wheel bearing tests at 104° C. Grease G could not be tested at either 163° C. or 104° C. because it was too fluid to pack in the wheel bearings. The results of all the above-described tests are set forth in Table I.

TABLE I

Wheel Bearing Performance For NLGI "0" Grade Pyrrolidone Greases As a Function of Unreacted Fatty Amine Content (Outside Preferred Range)

| Designation | A | B | C | D | E | F | G |
|---|---|---|---|---|---|---|---|
| Composition, wt. % | | | | | | | |
| Lithium Pyrrolidone Thickener | | | | 11.03 | 14.47 | 13.48 | 17.6 |
| Mineral Oil | (1) | (1) | (1) | 85.02 | 79.53 | 80.52 | 82.4 |
| Performance Adpack | | | | 3.95 | 6.00 | 6.00 | — |
| Unreacted Fatty Amine Content Prior to addition of Lithium Hydroxide | — | — | — | 13.8 | 16.4 | 27.4 | 81.0 |
| Inspections | | | | | | | |
| NLGI Consistency Grade | 2 | 2 | 1 | 0 | 0 | 0 | — |
| Worked Penetration mm/10 | 265/ 295 | 265/ 295 | 310/ 340 | 355/ 385 | 388 | 364 | Fluid |
| Droppong Point °C. | 288 | 246 | 233 | 292 | (2) | 305 | — |
| Wheel Bearing Test (60 g Pack; 6 hours) Leakage gm/Slumpage | | | | | | | |
| at 163° C. | 3.0/ nil | 2.4 nil | 3.8/ slump | 6.0/ slump | 4.9/ slump | 4.4/ slump | — |
| at 104° C. | — | — | — | — | — | 4.1/ | — |

TABLE I-continued

Wheel Bearing Performance For NLGI "0" Grade Pyrrolidone Greases As a Function of Unreacted Fatty Amine Content (Outside Preferred Range)

| Designation | A | B | C | D | E | F | G |
|---|---|---|---|---|---|---|---|
| | | | | | | slump | |

(1) Conventional non-pyrrolidone-containing reference greases
(2) Not run

EXAMPLE 4

Another series of tests (denoted as H, I, J, K, L in Table II) were conducted on greases prepared as described hereinabove, but the unreacted fatty amine content was 36.2 weight percent, 41.0 weight percent, 43.3 weight percent, 46.7 weight percent and 66.0 weight percent, respectively, prior to the addition of lithium hydroxide. All of these greases passed the wheel bearing tests at both 163° C. and 104° C., as may be seen from the data in Table II. In addition, the greases, which had unreacted fatty amine contents ranging between about 36 weight percent and about 66 weight percent prior to the addition of the lithium hydroxide, all had acceptable dropping point and shear stability.

TABLE II

Wheel Bearing Performance For NLGI "0" Grade Pyrrolidone Greases As A Function of Unreacted Fatty Amine Content (Within Preferred Range)

| Designation | H | I | J | K | L |
|---|---|---|---|---|---|
| Composition, wt. % | | | | | |
| Lithium Pyrrolidone Thickener | 12.50 | 12.73 | 12.73 | 11.77 | 11.08 |
| Mineral Oil | 81.50 | 81.27 | 81.27 | 82.80 | 83.52 |
| Performance Adpack | 6.00 | 6.00 | 6.00 | 5.43 | 5.40 |
| Unreacted Fatty Amine Content Prior to addition of Lithium Hydroxide | 36.2 | 41.0 | 43.3 | 46.7 | 66.0 |
| Inspections | | | | | |
| NLGI Consistency Grade | 0 | 0 | 0 | 0 | 0 |
| Worked Penetration mm/10 | 362 | 366 | 367 | 363 | 368 |
| Dropping Point °C. | (1) | 265 | 284 | 269 | (1) |
| Wheel Bearing Test (60 g Pack; 6 hours) Leakage gm/Slumpage | | | | | |
| at 163° C. | 3.5/ nil | 3.4/ nil | 2.9/ nil | 2.3/ nil | 3.1/ nil |
| at 104° C. | 1.0/ | 0.8/ | 1.2/ | 1.1/ | 1.5/ |

TABLE II-continued

Wheel Bearing Performance For NLGI "0" Grade Pyrrolidone Greases As A Function of Unreacted Fatty Amine Content (Within Preferred Range)

| Designation | H | I | J | K | L |
|---|---|---|---|---|---|
| | nil | nil | nil | nil | nil |

(1) Not run

EXAMPLE 5

To further demonstrate the criticality of the unreacted fatty amine level prior to the addition of the hydroxide on the finished lubricating grease performance, a series of comparative tests were performed. The tests were conducted on greases of the present invention to demonstrate the effect of the unreacted fatty amine level on the multi-grade properties of the lubricating greases. The NLGI rating was varied by adjusting the mineral oil and thickener concentration in the samples.

Samples D and D' (see Table III) having 13.8 weight percent unreacted fatty amine prior to the addition of lithium hydroxide and NLGI ratings of 0 and 2, respectively, were tested for performance at 163° C. While sample D' (having the NLGI #2 rating) passed the test, sample D, (having the NLGI #0 rating) failed to pass.

By comparison, samples K and K' (having unreacted fatty amine contents of 46.7 and 45.4 weight percent, respectively, prior to the addition of the lithium hydroxide and NLGI ratings of #0 and #2, respectively) were also tested at 163° C. As shown in Table III, both passed the wheel bearing tests at 163° C., thus demonstrating the importance of the unreacted fatty amine level prior to the lithium hydroxide addition on multi-grade lubricating grease performance.

TABLE III

| Designation | D' | D | K' | K |
|---|---|---|---|---|
| Composition: wt. % | | | | |
| Lithium Pyrrolidone Thickener | 16.98 | 11.03 | 17.40 | 11.77 |
| Mineral Oil | 79.07 | 85.02 | 77.17 | 82.80 |
| Performance Adpack | 3.95 | 3.95 | 5.43 | 5.43 |
| Unreacted Fatty Amine Content When Lithium Hydroxide Addition Commenced | 13.8 (1) | 13.8 (1) | 45.4 (2) | 46.7(2) |
| Inspections | | | | |
| NLGI Consistency Grade | 2 | 0 | 2 | 0 |
| ASTM Worked Penetration mm/10 | 295 | 363 | 293 | 363 |
| Dropping Point, °C. | >342 | 292 | >277 | 281 |
| Wheel Bearing Test (60 g Pack; 6 hours) Leakage gm/Slumpage at 163° C. | 1.8/nil | 6.0/slump | 1.0/nil | 2.3/nil |

(1) Made from the same laboratory master batch.
(2) Made from two laboratory batches. The small difference represents normal experimental variation.

EXAMPLE 6

In this Example, a pyrrolidone grease was prepared using the procedure of Example 2. However, the unreacted fatty amine content was allowed to decrease to 24.1% of the fatty amine originally present before the lithium hydroxide was added. After the lithium hydroxide was added and the grease "oiled-back", the grease had a final unreacted fatty amine content of 15% of that originally added. While the grease had a satisfactory dropping point of 320° C., the grease failed the wheel bearing test.

EXAMPLE 7

In this Example, the lithium hydroxide was added when the unreacted fatty amine content was 46.6% of that originally added. However, in this example the "cook-out" (i.e. crystallization) time after lithium hydroxide addition was increased and the unreacted fatty amine content in the final grease decreased to 12.9%. Although the final unreacted fatty amine content of this grease was lower than that of Example 6, the grease had acceptable dropping point and wheel bearing properties, thereby confirming that the unreacted fatty amine content prior to the addition of lithium hydroxide is the critical parameter and not the unreacted fatty amine content of the final grease.

The results from Examples 6 and 7 are summarized in Table IV below:

TABLE IV

| Example | % of Initial Fatty Amine Content Unreacted at LiOH Addition | % of Fatty Amine Unreacted in Final Grease | Drop PT (°C.) | Wheel Bearing Test @ 163° C. |
|---|---|---|---|---|
| 6 | 24.1 | 15.0 | 320 | Fail |
| 7 | 46.6 | 12.9 | 301 | Pass |

What is claimed is:

1. A method for manufacturing a NLGI #0 grade grease having the high temperature stay-in-place properties of a NLGI #2 grade grease which comprises:

A. reacting a pyrrolidone compound with a fatty amine in a base oil; and,

B. adding a metal compound selected from the group consisting of hydroxides, carbonates, alkoxides and mixtures thereof to the reaction when the unreacted fatty amine content ranges between about 33 and about 66 wt. % of the fatty amine originally added.

2. The method of claim 1 wherein the fatty amine is a $C_{12}$–$C_{30}$ straight chain amine.

3. The method of claim 2 wherein the fatty amine is a $C_{18}$–$C_{22}$ straight chain amine.

4. The method of claim 2 wherein the pyrrolidone compound has the formula:

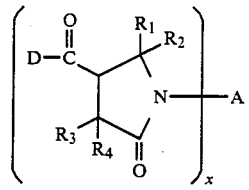

wherein x is 1 to 3, A is hydrocarbyl group of 1 to 50; D is the residue of hydroxyl portion of the carboxylic acid group which can be optionally free or neutralized with a suitable metal organo base or alcohol which provides one or two hydrocarbyl groups of 1 to 50 carbon atoms, with the proviso that there is at least one long chain hydrocarbyl group of at least 12 carbon atoms present in either D or A; and $R_1$, $R_2$, $R_3$ and $R_4$ are each hydrogen or a hydrocarbyl group of 1 to 6 carbon atoms.

5. The method of claim 4 wherein x=2.

6. The method of claim 5 wherein $R_1$, $R_2$, $R_3$ and $R_4$ are each hydrogen.

7. The method of claim 5 wherein A is

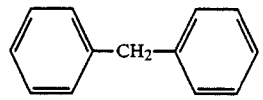

8. The method of claim 5 wherein the metal compound comprises a metal hydroxide.

9. The method of claim 8 wherein the metal hydroxide comprises lithium hydroxide.

10. The method of claim 8 wherein D is hydroxyl.

11. The method of claim 5 wherein the pyrrolidone compound is a bispyrrolidone having the structural formula

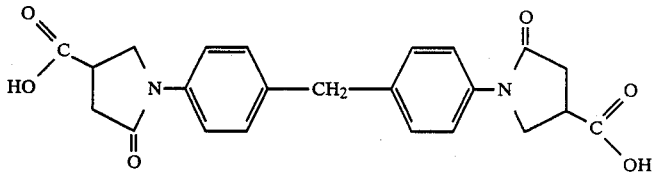

12. The method of claim 4 wherein the metal compound comprises a metal hydroxide.

13. The method of claim 12 wherein additional oil is added to the reaction subsequent to the addition of the metal hydroxide.

14. The method of claim 13 wherein the pyrrolidone compound comprises a bispyrrolidone.

15. A method for manufacturing a NLGI #0 grade grease having the high temperature stay-in-place properties of a NLGI #2 grade grease which comprises:

A. reacting bispyrrolidone with a $C_{12}$–$C_{30}$ straight chain amine in a base oil;

B. monitoring the extent to which the amine is reacted;

C. adding lithium hydroxide to the reaction when the unreacted fatty amine content ranges between about 33 and about 66% of the fatty amine originally added; and, D. subsequently adding base oil to the reaction.

16. The method of claim 15 wherein the oil content of the grease prior to the addition of the hydroxide ranges between about 30 and about 40 % of that ultimately added.

17. In a method for manufacturing a lubricating grease which comprises:

A. reacting a pyrrolidone with a fatty amine in a base oil; and,

B. adding a metal compound selected from the group consisting of hydroxides, carbonates, alkoxides and mixtures thereof to the mixture formed in A, the improvement which comprises adding said said metal compound to the mixture formed in A when the unreacted fatty amine content ranges about 36 and about 66 wt. % of the fatty amine originally added, thereby forming a NLGI #0 grade grease having the high temperature stay-in-place properties of a NLGI #2 grade grease.

18. The process of claim 17 wherein the unreacted fatty amine content ranges between about 40 and about 55 wt. % of the fatty amine originally added.

* * * * *